US009732750B2

(12) United States Patent
Barron

(10) Patent No.: US 9,732,750 B2
(45) Date of Patent: Aug. 15, 2017

(54) METERING PUMP MADE OF PLASTIC

(71) Applicant: Robert Bosch GmbH, Stuttgart (DE)

(72) Inventor: Dan Barron, Schaffhausen (CH)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 14/782,491

(22) PCT Filed: Mar. 6, 2014

(86) PCT No.: PCT/EP2014/054352

§ 371 (c)(1),
(2) Date: Oct. 5, 2015

(87) PCT Pub. No.: WO2014/161700

PCT Pub. Date: Oct. 9, 2014

(65) Prior Publication Data

US 2016/0053757 A1 Feb. 25, 2016

(30) Foreign Application Priority Data

Apr. 3, 2013 (DE) ..... 10 2013 205 843

(51) Int. Cl.
*F03C 4/00* (2006.01)
*F04C 2/00* (2006.01)
(Continued)

(52) U.S. Cl.
CPC ..... *F04C 2/126* (2013.01); *F04B 13/02* (2013.01); *F04C 2/084* (2013.01); *F04C 11/005* (2013.01);
(Continued)

(58) Field of Classification Search
CPC .. F04C 2/126; F04C 2/084; F04C 2/16; F04C 11/001; F04C 11/005; F04C 15/0034;
(Continued)

(56) References Cited

U.S. PATENT DOCUMENTS 3,054,417 A 9/1962 Corvisier
4,090,262 A 5/1978 Schneider et al.
(Continued)

FOREIGN PATENT DOCUMENTS

DE 1553120 4/1970
EP 1892417 2/2008
(Continued)

OTHER PUBLICATIONS

International Search Report for Application No. PCT/EP2014/054352 dated Apr. 14, 2014 (English Translation, 2 pages).

*Primary Examiner* — Theresa Trieu
(74) *Attorney, Agent, or Firm* — Michael Best & Friedrich LLP

(57) ABSTRACT

A disposable metering pump is made of plastic for products having solid fractions. The disposable metering pump has two rotors (10) which are coupled to each other by means of gears (11), can be driven in opposite directions, and are supported in a pump housing (5). Each rotor (10) has a rotor shaft, the rotor shaft ends (15) of which are supported in the walls of the pump housing (5). Each rotor (10) has two rotor blade walls (13), which are arranged diametrically opposite on the rotor shaft. One partially cylindrical rotor blade shoe (14) is formed at each of the peripheral ends of the rotor blade walls. The rotor blade shoes (14) lie against the cylindrical inner wall regions of the pump housing (5) in a sliding and sealing manner.

11 Claims, 4 Drawing Sheets

(51) Int. Cl.

| | |
|---|---|
| ***F04C 18/00*** | (2006.01) |
| ***F04C 2/12*** | (2006.01) |
| ***F04C 2/08*** | (2006.01) |
| ***F04B 13/02*** | (2006.01) |
| ***F04C 11/00*** | (2006.01) |
| ***F04C 15/00*** | (2006.01) |
| ***F04C 15/06*** | (2006.01) |

(52) U.S. Cl.
CPC ..... *F04C 15/0034* (2013.01); *F04C 15/0061* (2013.01); *F04C 15/06* (2013.01); *F05C 2225/00* (2013.01)

(58) Field of Classification Search
CPC ..... F04C 15/0061; F04C 15/06; F04B 13/02; F05C 2225/00
USPC ..... 418/206.1–206.9, 205, 152, 153
See application file for complete search history.

(56) References Cited

U.S. PATENT DOCUMENTS

| | | | | |
|---|---|---|---|---|
| 5,558,116 | A | 9/1996 | Dubach | |
| 7,878,783 | B2 * | 2/2011 | Kunz | F04C 2/084 418/206.9 |
| 2008/0038138 | A1 * | 2/2008 | Bishop | F04C 2/126 418/206.1 |

FOREIGN PATENT DOCUMENTS

| | | | | |
|---|---|---|---|---|
| GB | 1048263 A | * | 11/1966 | F04C 2/084 |
| WO | 9524556 | | 9/1995 | |
| WO | 2007028429 | | 3/2007 | |

* cited by examiner

METERING PUMP MADE OF PLASTIC

BACKGROUND OF THE INVENTION

The present invention relates to a plastics metering pump, comprising two rotors which are coupled to each other by means of gearwheels and can be driven in opposite directions and which are mounted in a pump housing provided with suction connection and outlet connection, wherein each rotor has a rotor shaft, the rotor shaft ends of which are supported in the walls of the pump housing.

Metering pumps are known in all sizes and construction types. As plastics metering pumps are known, in particular, manually operated piston pumps, as are known on soap dispensers for liquid soaps or, as here particularly of interest, also in the hotel and catering industry, where, for instance in fast food outlets, mustard, ketchup or coffee cream are dispensed in metered volume with such manually operated piston pumps. Despite these metering pumps, the dispensed quantity varies relatively strongly however, since, in the metering pumps, in particular of the kind just described, the stroke path should actually be fully utilized with each actuation, yet this is generally not the case. Instead, one, two or three short strokes are often performed and the quantity accordingly varies very strongly. As long as this quantity is dispensed merely as the accompaniment to a hamburger, this is of only minor importance. However, where such metering pumps are also used to add a specific quantity of a liquid food to a recipe, the taste is varied by incorrect actuation, which is not always appreciated by the customers.

Although various different pumps are perfectly well known, in particular including rotor pumps, these are mostly designed as relatively high-precision metering pumps made of metal, and this is also necessary in the food industry, where large quantities have to be dispensed in metered volume. For commercial application, however, mostly very cheap disposable metering pumps are provided, generally free of charge. Accordingly, such metering pumps must be made of plastic, have a structure which is as simple as possible, and work reliably.

The plastics metering pump which is here of interest should in particular be conceived for foods which are dispensed in so-called tubular bags, or other flexible packagings made of plastics sheets.

Many liquid foods also contain relatively large solid components. Typical examples of liquid foods of this kind are, for instance, tartare sauce, mustard sauces with pickles, vanilla sauce with chocolate and almond slivers, etc. With the currently standard metering pumps, liquid foods of this kind cannot be dispensed in metered volume. In particular with so-called gear pumps, as one such is represented, for instance in FR-2313971, this is scarcely realizable. In the case of larger solid particles, such as, for instance, almond sticks, these are ground by the rotors or block the rotors. Accordingly, for such metering pumps, in particular metering pumps in which the rotors have two-bladed or multi-bladed rolling elements, enter into consideration. Examples of such pumps are known from U.S. Pat. No. 3,054,417, where a metering pump for liquid mediums for the admixture of further liquids is shown, wherein in this case each rotor has three impellers and these impellers roll one against another and thus transport the medium onward. In such pumps, between the housing and the individual rotor blades there is sufficient space to transport also liquids with solid parts. Here the larger solid parts are less a problem than, in fact, the smaller solid parts, which remain stuck to the rotor blades rolling mutually one against another and in the course of the rolling process, are completely crushed, whereupon a coating can form, which coating reduces the discharge capacity and can even lead to blockages.

The same also applies to a metering pump of WO 95/24556, in which only two-bladed rotors are represented, but which rotors likewise roll mutually both one against another and against the housing wall.

A further rotary piston pump is known from EP-1 892 417. This is conceived, however, as an insert for an outer metallic housing, but is created for single use and has a housing made of plastic. The toothed gear with which the correct relative position of the two rotors is ensured is a component part of a gearing disposed outside the actual pump and not a component part of the parts provided for single use. Although the rotors, which intermesh during operation, have concave recesses, these are not shaped in such a way that the rotary piston pump is particularly suitable for products with solid components. In particular, the comparatively tight radii of the concave recesses allow deposits to develop precisely in these regions, which deposits remain in the pump and, in the case of foods, possibly quickly perish through contact with the outside air.

SUMMARY OF THE INVENTION

Consequently, the object of the present invention is to provide an improved disposable metering pump which has a relatively large discharge capacity and is particularly suitable for the conveyance of solid-liquid mixtures without herein possessing the previously described drawbacks.

This object is achieved by a plastics metering pump of the type stated in the introduction, which is distinguished by the fact that each rotor has rotor blade shoes and concave recesses which are optimized in their shaping with regard to the attainment of minimal product residues.

Optimization with regard to the attainment of minimal product residues here means that the shaping of the rotor blade shoes and of the concave recesses is configured and mutually coordinated such that either no or only as few as possible product residues get stuck in the concave recess regions, or that stuck product residues in the concave recess regions are scraped off again, as fully and as continuously as possible, by the end edges of the rotor blade shoes during operation and transported onward.

In a preferred embodiment, each rotor has for this purpose partially cylindrical rotor blade shoes and concave recesses, the respective curvatures or radii of curvatures of which are in parts at least approximately equal in size. The precise curves are naturally obtained from the oppositely directed rolling or meshing motions of the two rotors.

BRIEF DESCRIPTION OF THE DRAWINGS

Further advantageous embodiments of the subject of the invention emerge from the dependent claims, and their importance and working method are described in the following description with reference to the appended drawing.

In the drawings, a preferred illustrative embodiment of the subject of the invention is represented, wherein:

FIG. 3 shows the metering pump, once again, in a side view, the detachable pump housing wall having been omitted, while

DETAILED DESCRIPTION

Figure 1:
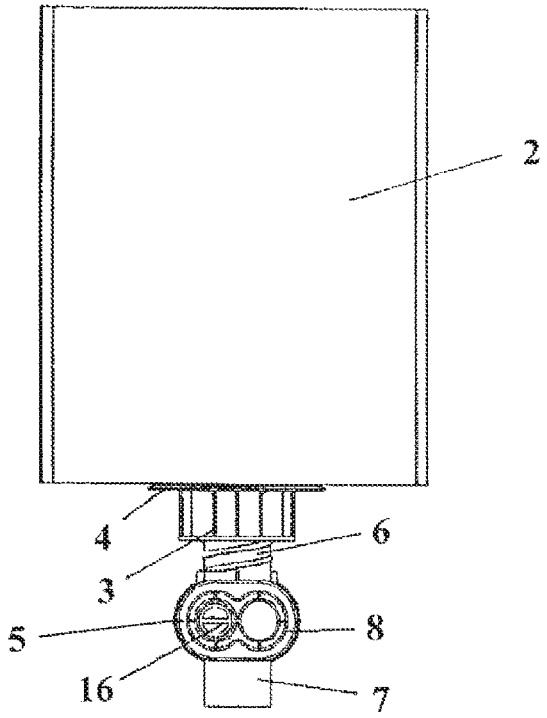
FIG. 1 shows a preferred use of the disposable metering pump according to the invention, fitted on a tubular bag.

In FIG. 1, a preferred application of the metering pump according to the invention, denoted in its entirety by 1, is represented symbolically on a tubular bag 2. The metering pump 1 is held on the tubular bag 2 by means of a fastening connection 3 provided with a flange 4. The connection of the flange 4 to the tubular bag 2 is preferably made by ultrasonic welding.

The metering pump itself possesses a pump housing 5 having a suction connection 6 and an outlet connection 7. The suction connection 6 is screw-connected to the fastening connection 3. The metering pump itself is here shown with a view onto a fixed end wall 8 of the pump housing 5, wherein a rotor shaft end 15, provided with a drive coupling part 16, here juts through the aforementioned fixed end wall 8 and the drive coupling part 16 is apparent. The drive coupling part serves to be positively connected to a drive means (not represented here).

Figure 2:
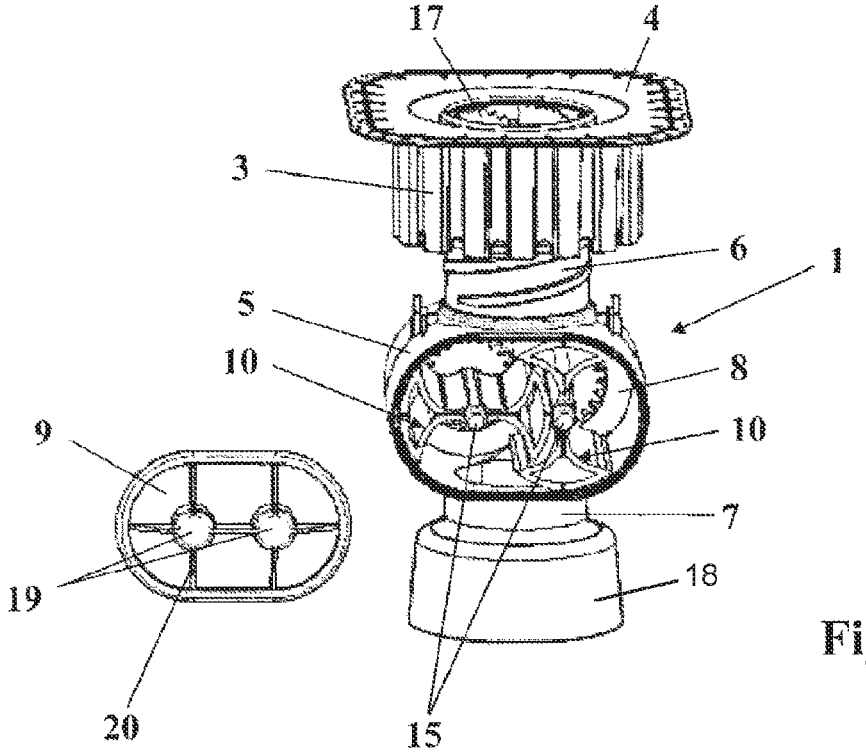
FIG. 2 shows a perspective view of the disposable metering pump of FIG. 1 with the fastening connections, wherein the detachable pump housing wall has been removed.

In FIG. 2, the metering pump 1 with the fastening connection is represented in isolation. In this perspective view, the view is directed obliquely from above onto the aforementioned flange 4 and opening means 17 are apparent, which are here configured as perforating and cutting teeth and, in this position, prior to first use, still lie fully within the suction connection 6. Prior to first use, the pump housing 5, with its suction connection 6, will be screwed in the fastening connection 3 as far as a stop, whereupon the aforementioned opening means 17 cut open an aseptically closed container, preferably a tubular bag made of plastics sheet. In that transport position of the metering pump 1 which is represented here, the outlet connection 7 is provided, moreover, with a closing cover 18, which ensures that, during the transport and storage, no foreign substances or foreign particles can make their way into the metering pump.

In FIG. 2, the pump housing 5 is represented open. While in FIG. 1, as already mentioned, the view is directed onto the fixed end wall 8 of the pump housing 5, here the metering pump 1 is represented rotated through 180° and the view is directed onto that side of the metering pump 1 which has a detachable end wall 9. This detachable end wall 9 is shown laterally offset or detached. The detachable end wall 9 can also be referred to as a pump housing cover. In this figure, the view is directed onto the outer side of the pump housing cover and outwardly protruding, closed bearing bushings 19 are apparent, which on the inner side (see also FIG. 7 in this regard) are capable of receiving the rotor shaft ends 15. The outwardly closed bearing bushings 19 are held stabilized with stiffening ribs 20 on the outer side of the detachable end wall 9.

Figure 3:
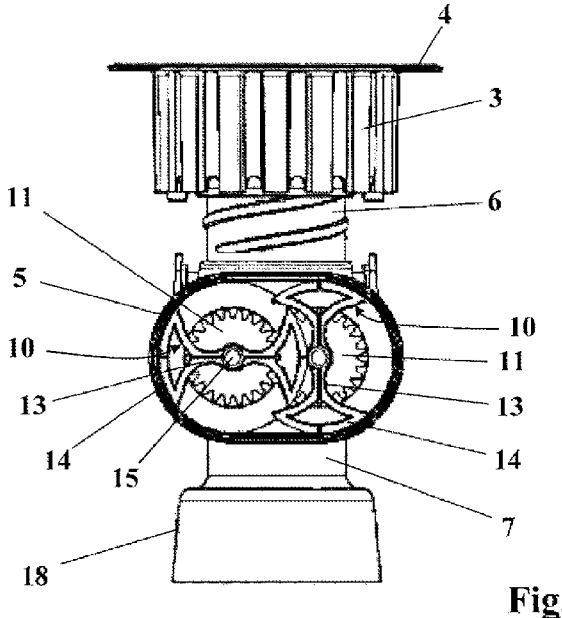

In FIG. 3, the metering pump 1 is shown in side view, yet in the same usage position as in FIG. 2, though with the detachable end wall 9 of the pump housing 5 having been omitted. In this view can clearly be seen the two rotors 10, which are mounted in the pump housing 5 and onto which are formed, preferably integrally, gearwheels 11, which cause the two rotors to move in opposite directions when one of the two rotors is driven. With regard to the exact configuration of the two rotors 10, reference is made to the following FIGS. 4 and 5. In FIG. 3, it is apparent that each rotor is provided with a rotor shaft 12, wherein the view is here directed onto the rotor shaft ends 15, and wherein two mutually diametrically opposing rotor blade walls 13 are respectively formed onto the rotor shafts 12. Onto the peripheral ends of the rotor blade walls 13 is respectively formed a rotor blade shoe 14. Each rotor blade shoe possesses a partially cylindrical shape, which is matched in curvature to the cylindrical part of the pump housing 5. As can be seen here (but also from FIG. 8), each rotor blade shoe 14 either bears constantly onto the inner side of the pump housing or, with an end edge 22 of the rotor blade shoe 14, grazes a concave recess 24 of the adjacent rotor.

Figure 4:
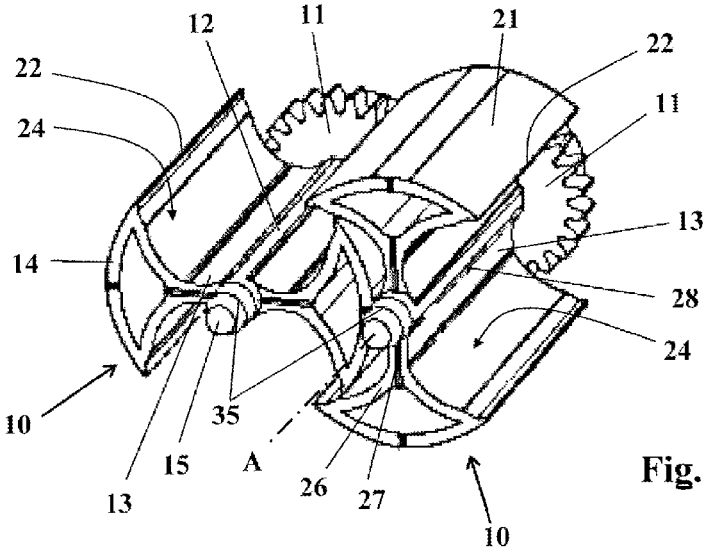
FIG. 4 shows the two rotors in isolation in correct relative position to each other in perspective view.

In FIG. 4, the configuration of the two rotors can now be seen in detail. Although these are represented in isolation in a correct relative position as provided in the installation, the pump housing 5 has been omitted. The parts mentioned already in connection with FIG. 3, namely the rotor shaft 12 and the corresponding rotor shaft ends 15, are here referred to once again. The specific embodiment of the rotor blade shoes 14 and of the rotor blade walls 13 can be seen particularly clearly in this figure. As already mentioned, the rotor blade shoes 14 are integrally formed onto the peripheral ends of the rotor blade walls 13. The rotor blade shoes 14 have a partially cylindrical outer face 21 having end edges 22. The radius of curvature of this outer face corresponds to the distance between the axis A which passes through the middle of the rotor shaft 12, running in the longitudinal direction thereof, and the outer face 21 of the rotor blade shoes 14. Furthermore, concave recesses 24 are formed on both sides, between the rotor shafts 12 and the rotor blade shoes 14, into the rotor blade walls and the rotor blade shoes 14 respectively. The bilaterally identical concave recesses 24 merge in a region close to the rotor shafts into the actual (relatively narrow) rotor blade walls 13.

As already mentioned, the shaping of the rotor blade shoes and of the recesses is with regard to minimal product residues. As can be seen from FIG. 4, the curvature of the partially cylindrical rotor blade shoes 14 and the curvature of the concave recesses 24 is at least approximately equal in size. With this design optimization, the aim is that, in the region of the concave recesses 24, as far as possible no niches exist in which material residues could remain such that they cannot not be scraped off.

Preferably, both rotors 10 are absolutely identical in design, moreover, in order that only one injection mold is required for their production. This also has the advantage that also no source of error arises in the assembly when the two rotors have the same design.

The metering pump according to the invention is preferably designed practically such that the pump seals the connection between the suction connection 6 and the outlet connection 7. To this end, the pump or its rotors 10 and the pump housing 5 have sealing elements. However, these sealing elements have at the same time also a cleaning effect and prevent deposits in the pump housing, which deposits which might lead to a reduction in quality and to leaks, and also, in the worst case, to blockages of the pump.

In FIG. 4 it is additionally apparent that the rotor blade walls 13 possess end faces 26. On the end faces 26, which in the installed state of the rotors in the pump housing 5 end up toward the detachable end wall 9 or the pump housing cover, is respectively arranged a sealing lip 27, extending from the middle of the rotor shaft ends 15 to the outer face 21 of the rotor blade shoes 14. Bearing onto the opposite end face, which is not visible here (see FIG. 5 in this regard), are the gearwheels 11, such that these are integrally connected to the end faces. Here, such sealing lips will be fitted to the corresponding end face sections such that they run only from the corresponding gearwheel to the outer face 21 of the rotor blade shoes.

In order that also the rotor blade shoes 14 are sealed with respect to the rotor shaft 12, also longitudinal scraping ribs 28 are fitted on the rotor shaft 12. These longitudinal scraping ribs 28 run parallel to the axis A of the rotor shaft 12. In principle, it is here sufficient to fit in each case one longitudinal scraping rib 28 on each rotor shaft 12, though preferably two such longitudinal scraping ribs are respectively fitted on the same side. These longitudinal scraping ribs 28 not only have a sealing effect, but also clean the rotor blade shoes 14, on the outer side 21 thereof, of any deposits which might form there. By virtue of these design features, to all intents and purposes a metering pump which is self-cleaning and very low in residues is formed.

Figure 5:
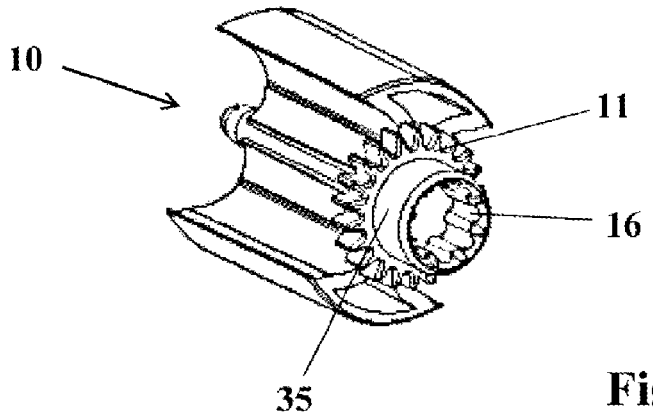
FIG. 5 shows a single rotor in perspective view, viewed from the gearwheel side.

For the purposes of better understanding, FIG. 5 shows another rotor in perspective view from the gearwheel side. Here, the integrally formed-on gearwheel 11, as well as the drive coupling part 16, are clearly apparent.

Figure 6:
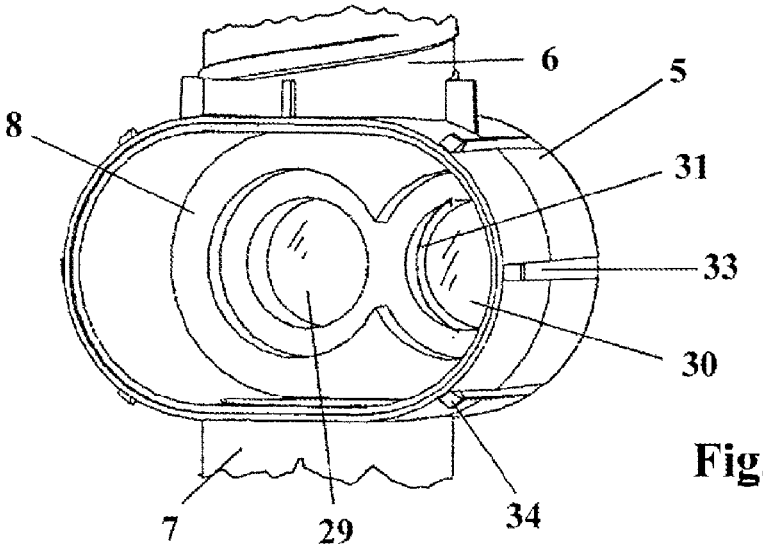
FIG. 6 represents a perspective partial view of the pump housing in isolation.

In FIG. 6, the pump housing 5 is represented in isolation. The suction connection 6 and the outlet connection 7 can be seen only to some extent. In this view too, the pump housing cover, or the detachable end wall 9 of the pump housing 5, is once again removed. The view is thus directed onto the inner side of the fixed end wall 8 of the pump housing 5. Second bearing bushings 29, 30 are formed herein. one second bearing bushing 29 being of closed design and the other second bearing bushing 30 being continuously open to the outside. Into this open bearing bushing 30 is preferably formed a circumferential sealing lip 31 of lesser height. A plurality of such circumferential sealing lips 31 can also however be present and thus form, to all intents and purposes, a type of labyrinth seal.

With reference to FIGS. 4 and 5, it can be seen that the rotors 10 have on their rotor shafts 12, on both sides, rotor shaft ends 15, which are designed as bearing journals 35. The bearing journals 35 on the side of the pump housing cover 9 have a smaller diameter, while the bearing journals 35 on the other, gearwheel side have a substantially larger diameter. Since as already mentioned, however, the two rotors are identical in design, both rotors also have on that rotor shaft end with the larger diameter the aforementioned drive coupling part 16, which has already been described with reference to FIGS. 1 and 5. While the open bearing bushing 30 is arranged on the left in FIG. 1, and thus the drive coupling part 16 (which can of course be variously designed) is recognized there, the closed bearing bushing 29 is represented on the right in FIG. 1. In FIG. 6, in which the pump housing is now seen from the inner side, the closed, second bearing bushing 29 is consequently apparent on the left and the second, open bearing bushing 30 on the right. Only in the second, open bearing bushing 30 will the aforementioned circumferential sealing lip 31 be fitted.

Figure 7:
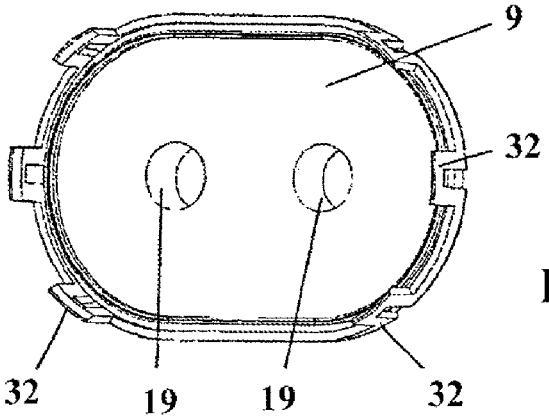
FIG. 7 represents the detachable pump housing wall in perspective view with a view onto the inner side thereof.

In FIG. 7, the detachable end wall 9 or the pump housing cover is now represented in isolation. On the circumferential rim can be recognized a plurality of flexible tongues 32, which on the outside of the pump housing 5, in the closed state of the pump housing cover, hook onto the latching means 33 with appropriate cams 34.

As already mentioned, bearings are also formed into the detachable end wall 9. These are here referred to, however, as closed bearing bushings 19. Since these bearing bushings 19 are closed, no additional sealing means are necessary here. The diameter of these closed bearing bushings 19 is substantially smaller than the diameter of the two bearing bushings 29 and 30. In these closed bearing bushings 19 engage the rotor shaft ends 15, which are designed as bearing journals 30, as can most clearly be seen in FIG. 4.

Figure 8:
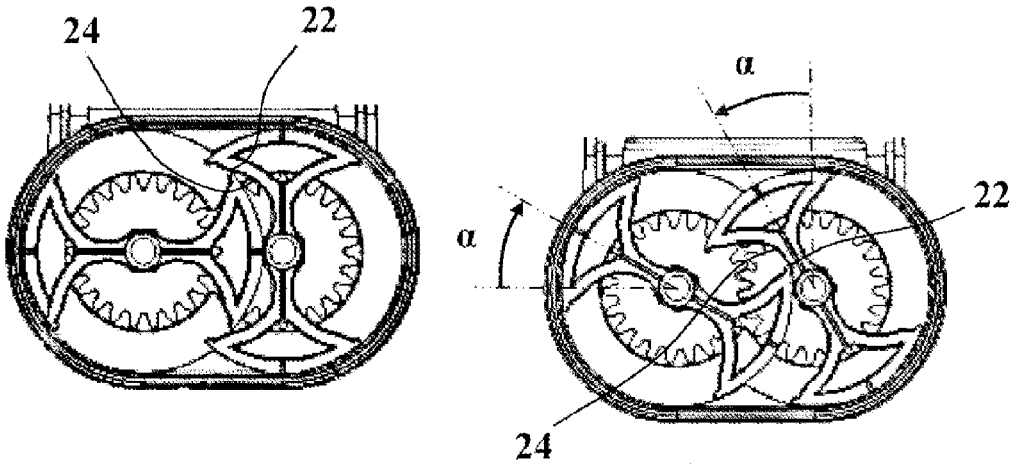
FIG. 8 shows the meshing of the two rotors in two different angular positions.

Finally, by way of further illustration, FIG. 8 shows the meshing of the two rotors 10 in two different angular positions. Analogously to FIGS. 2-4, the two rotors are shown on the left-hand side of the diagram in a correct first relative position, as in installation. Since the two rotors 10 rotate in opposite directions, the position thereof following rotation through an angle $\alpha$ is represented on the right-hand side of the diagram in turn in a correct second relative position. It is clearly apparent that the end edges 22 of the rotor blade shoes 14 touchingly brush the concave recesses 24 of the adjacent rotor. It is thus clearly illustrated that the end edges of the rotor blade shoes respectively follow the curvatures of the concave recesses, to be precise, as intended in such a way that any residues in the concave recesses are scraped off and transported onward. Because this brushing, in dependence on other design specifications for the disposable metering pump, may possibly not always be ideally achieved, with regard to the shaping of the rotor blade shoes and of the recesses, an optimization with regard to minimal product residues is spoken of. "Optimization" thus means, in the mathematical sense, that a pay-off function is minimized or maximized.

With the here described metering pump 1, fluids, and also mixtures of fluids and solids, can be conveyed without difficulty. The size of the solid particles is here practically immaterial, though they must, of course, be of a size that is smaller than the distance between the two rotor shafts. Whether the solid parts are coarse-grained or fine-grained, and thus have a greater or lesser tendency to form deposits, is immaterial however. On the one hand, the solid parts are not ground and, on the other hand, the depositing thereof on the pump housing, as well as on the rotor blade shoes or on the rotor shafts, is continually removed by the means previously described. It is thereby ensured that the metering pump, which serves as a disposable metering pump, always operates reliably for the working life which is necessary. Since moreover, by virtue of the previously described design, a high sealing tightness exists between the outlet connection 7 and the tubular bag 2, a practically aseptic state is maintained in the tubular bag throughout the emptying process. Accordingly, the food which is supplied in the fully closed aseptic tubular bag can be offered without, or at least with substantially less preservatives.

REFERENCE SYMBOL LIST

1 metering pump
2 tubular bag
3 fastening connection
4 flange
5 pump housing
6 suction connection
7 outlet connection
8 fixed end wall of the pump housing
9 detachable end wall of the pump housing (pump housing cover)
A axis of the rotor shaft
10 rotor
11 gearwheels
12 rotor shaft
13 rotor blade walls

14 rotor blade shoes
15 rotor shaft ends
16 drive coupling part
17 opening means
18 closing cover
19 closed bearing bushings
20 stiffening ribs
21 outer face of the rotor blade shoes
22 end edge of the rotor blade shoes
23 unused
24 concave recess
25 unused
26 end face
27 sealing lip
28 longitudinal scraping ribs
29 second bearing bushings, closed
30 second bearing bushings, open
31 circumferential sealing lip in open bearing bushing
32 flexible tongues
33 latching means
34 cams
35 bearing journals
$\alpha$ angle

What is claimed is:

1. A plastic disposable metering pump (1) for products with solid components, the metering pump comprising two rotors (10) which are coupled to each other by gearwheels (11), are driven in opposite directions and are mounted in a pump housing (5) provided with a suction connection (6) and an outlet connection (7), wherein the rotors have respective rotor shafts (12), rotor shaft ends (15) of which are supported in walls (8, 4) of the pump housing (5), and wherein each of the rotors (10) has two rotor blade walls (13), which are arranged diametrically on an associated rotor shaft (12) and onto peripheral ends of which are formed respective partially cylindrical rotor blade shoes (14), wherein the rotor blade shoes (14) bear slidingly and sealingly against cylindrical inner wall regions of the pump housing (5), and wherein, furthermore, the rotor blade walls (13) have between the rotor shafts (12) and the rotor blade shoes (14) on both sides concave recessed surfaces (24), wherein end edges of the rotor blade shoes (14) of one of the rotor blade shoes (14) engage along the recessed surfaces (24) of the other rotor blade shoe (14) during operation, and wherein at least one longitudinal scraping rib (28) protrudes radially outwardly from one of the rotor shafts (12), wherein the at least one longitudinal scraping rib (28) engages along the rotor blade shoes (14) during operation.

2. The metering pump as claimed in claim 1, characterized in that a curvature of the partially cylindrical rotor blade shoes (14) and a curvature of the concave recesses (24) is equal in size.

3. The metering pump (1) as claimed in claim 1, characterized in that a gearwheel (11) is integrally formed onto each of the rotor shafts (12).

4. The metering pump (1) as claimed in claim 3, characterized in that the pump housing (5) has an end wall (8) fixedly connected to the pump housing (5) and an end wall (9) detachable therefrom, wherein at least one rotor shaft end (15) has a drive coupling part (16) which passes through the pump housing (5) and passes through the end wall fixedly connected to the pump housing (5).

5. The metering pump (1) as claimed in claim 4, characterized in that both rotors (10) are identical and both thus have a drive coupling part (16), wherein one drive coupling part (16) is supported in a second, open bearing bushing (30) and an other drive coupling part in an outwardly closed bearing bushing (29).

6. The metering pump (1) as claimed in claim 5, characterized in that into the second, open bearing bushing (30) is integrally formed at least one circumferential sealing lip (31).

7. The metering pump (1) as claimed in claim 4, characterized in that on the rotor blade walls (13), on end faces (26) of the rotor blade walls (13) remote from an associated gearwheel (11), is provided at least one sealing lip (27) for sealing contact against the detachable end wall (9) of the pump housing (5).

8. The metering pump (1) as claimed in claim 1, characterized in that on each of the rotor shafts (12) is arranged at least one longitudinal scraping rib (28), which is directed radially outward and runs parallel to a rotor shaft axis (A).

9. The metering pump (1) as claimed in claim 8, characterized in that between the two rotor blade walls (13), on both sides of the rotor shaft (12), are arranged two parallel longitudinal scraping ribs (28).

10. The metering pump (1) as claimed in claim 1, wherein each rotor blade shoe (14) has a first curvature, wherein each concave recess (24) has a second curvature, wherein the first curvature is identical to the second curvature.

11. The metering pump (1) as claimed in claim 1, wherein only two separate longitudinal scraping ribs (28) protrude outwardly from one of the rotor shafts (12), on opposite sides of the rotor shaft (12).

* * * * *